US012723481B2

(12) United States Patent
Pasicznyk et al.

(10) Patent No.: US 12,723,481 B2
(45) Date of Patent: Sep. 1, 2026

(54) SYSTEM AND METHOD FOR ANCHORING AND STROKING A DOWNHOLE MOTOR MILLING ASSEMBLY IN A FLOATING RIG ENVIRONMENT

(71) Applicant: Halliburton Energy Services, Inc., Houston, TX (US)

(72) Inventors: Adam Michael Pasicznyk, Spring, TX (US); Esiquiel Marquez, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/987,574

(22) Filed: Dec. 19, 2024

(65) Prior Publication Data

US 2026/0176929 A1 Jun. 25, 2026

(51) Int. Cl.
*E21B 29/06* (2006.01)
*E21B 4/02* (2006.01)
*E21B 7/06* (2006.01)

(52) U.S. Cl.
CPC ..... *E21B 29/06* (2013.01); *E21B 4/02* (2013.01); *E21B 7/061* (2013.01)

(58) Field of Classification Search
CPC ..... E21B 29/06; E21B 7/06; E21B 7/061
See application file for complete search history.

(56) References Cited

U.S. PATENT DOCUMENTS 4,346,761 A * 8/1982 Skinner ..... E21B 43/114 166/206
6,092,601 A 7/2000 Gano et al.
9,109,410 B2 8/2015 Swietlik et al.
11,193,340 B2 12/2021 Bansal et al.
2006/0231258 A1* 10/2006 Head ..... E21B 29/06 166/384
2009/0266544 A1* 10/2009 Redlinger ..... E21B 47/09 166/298
2016/0069138 A1 3/2016 Zupanick
2017/0198538 A1* 7/2017 Hansen ..... E21B 17/10
2018/0106122 A1 4/2018 McAfee et al.
2021/0079747 A1 3/2021 Grindhaug et al.
2023/0349254 A1 11/2023 Alexander et al.
2024/0200417 A1 6/2024 Quero
2024/0352819 A1 10/2024 Maribu et al.

FOREIGN PATENT DOCUMENTS

EP 1485570 B1 10/2007

OTHER PUBLICATIONS

International Search Report and Written Opinion for International Patent Application No. PCT/US2025/010460 dated Sep. 15, 2025. PDF file. 9 pages.

* cited by examiner

*Primary Examiner* — Kristyn A Hall
(74) *Attorney, Agent, or Firm* — Scott Richardson; C. Tumey Law Group PLLC

(57) ABSTRACT

Provided herein are various embodiments of a downhole motor milling assembly having a tubular string, a flow-by anchor positioned on the tubular string, a stroking device positioned on the tubular string and downhole from the flow-by anchor, a downhole motor positioned on the tubular string and downhole from the stroking device, and a milling assembly positioned on an end of the tubular string. Further milling assemblies provide where the flow-by anchor temporarily attaches to a casing while permitting mud to flow past the flow-by anchor.

20 Claims, 9 Drawing Sheets

SYSTEM AND METHOD FOR ANCHORING AND STROKING A DOWNHOLE MOTOR MILLING ASSEMBLY IN A FLOATING RIG ENVIRONMENT

BACKGROUND

Maintaining weight on a downhole mill in a floating rig environment is challenging due to the dynamic nature of floating rigs, which can be affected by sea movements, wind, and weather conditions. Floating rigs, unlike fixed platforms, move with ocean waves, currents, and wind. This constant movement causes the drill string and milling tools to fluctuate in weight-on-bit (WOB). When the rig heaves up or down, it affects the applied weight, making it difficult to keep a consistent force on the mill. While most floating rigs have heave compensators, these systems are designed to absorb some of the vertical motion and maintain consistent weight, but they're not perfect. They may still allow some variance in WOB, especially with heavy or high-friction tools like a downhole mill. The pressure dynamics and fluid weight distribution vary more on a floating rig. As the rig moves, the hydrostatic pressure on the milling tool changes, which affects downhole weight and mud pressure stability. With the constant changes in tension and compression in the drill string caused by the rig's movement, the mill may experience oscillating forces. This can result in cyclic weight variations on the mill, making it difficult to maintain steady, effective downhole milling.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
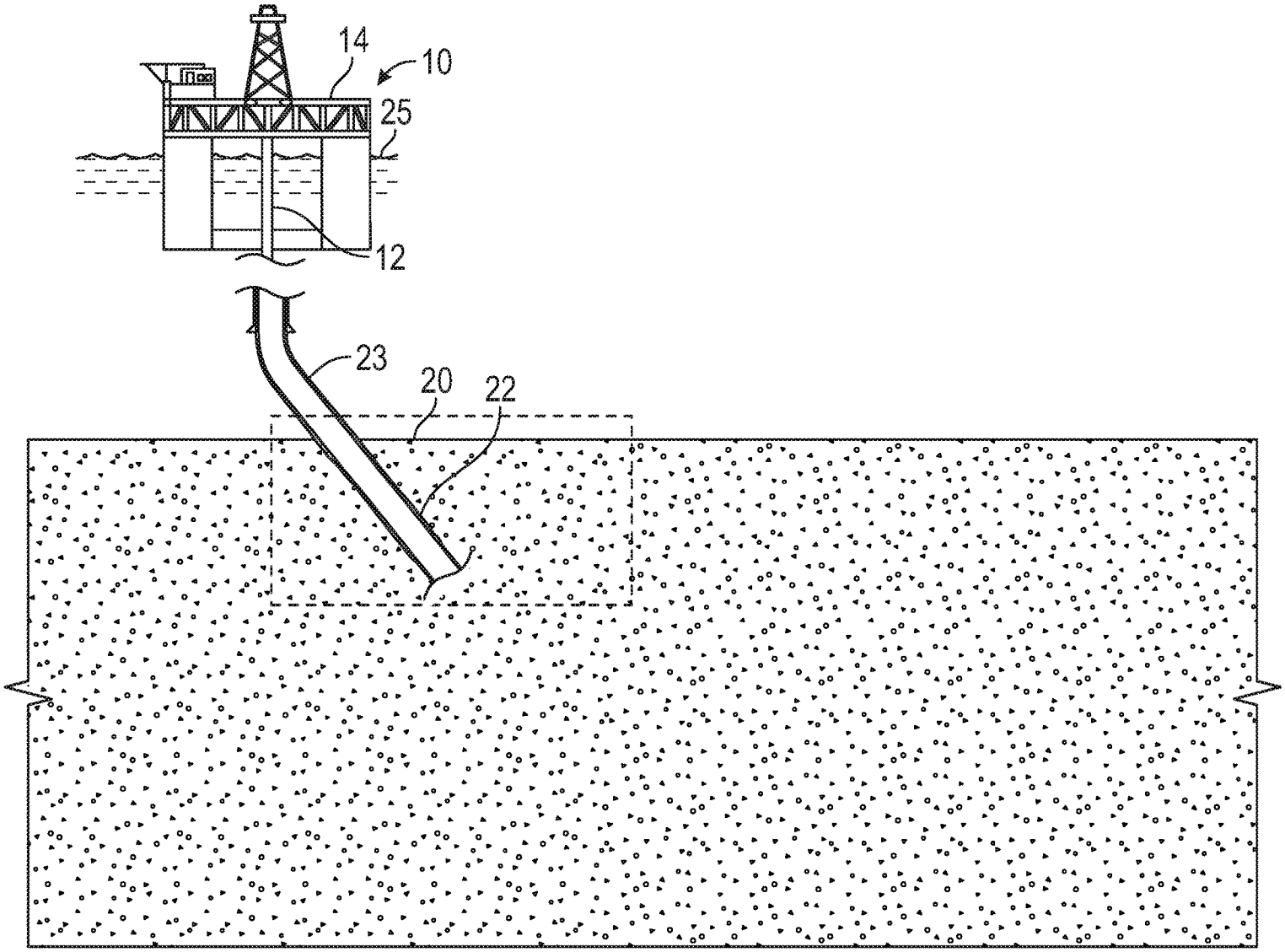
FIG. 1 illustrates a cross-sectional view of a floating rig well system in accordance with some embodiments of the present disclosure and showing the location for Detail A within the downhole portion of the floating rig well system.

Provided herein are various embodiments of a downhole motor milling assembly having a tubular string, a flow-by anchor positioned on the tubular string, a stroking device positioned on the tubular string and downhole from the flow-by anchor, a downhole motor positioned on the tubular string and downhole from the stroking device, and a milling assembly positioned on an end of the tubular string. Further milling assemblies provide where the flow-by anchor temporarily attaches to a casing while permitting mud to flow past the flow-by anchor.

Further milling assemblies provide where the flow-by anchor holds a position within a casing while cuttings travel up-hole through an annular area. Further milling assemblies provide where the flow-by anchor holds a position within a casing while the milling assembly performs a milling operation. Further milling assemblies provide where the flow-by anchor holds a position within a casing while the flow of mud through the main tubular string causes the downhole motor to rotate. Further milling assemblies provide where the flow-by anchor holds a position within a casing while the stroking device extends linearly. Further milling assemblies provide where the stroking device extends in a direction that is downhole.

Provided herein are various embodiments of a downhole motor milling assembly having a tubular string, a flow-by anchor positioned on the tubular string, slips which extend outwardly from the flow-by anchor to temporarily attach to a casing, a stroking device positioned on the tubular string and downhole from the flow-by anchor, a downhole motor positioned on the tubular string and downhole from the stroking device, and a milling assembly positioned on an end of the tubular string. Further milling assemblies provide where a flow of mud downhole through the main tubular string causes the stroking device to extend linearly. Further milling assemblies provide an orientation anchor attached to the casing.

Further milling assemblies provide a deflector attached to the orientation anchor. Further milling assemblies provide where the slips engage with the casing to hold the flow-by anchor in a temporarily fixed position relative to the casing while the milling assembly removes a portion of the casing. Further milling assemblies provide where the flow-by anchor allows mud to travel downhole through the tubular string while simultaneously permitting cuttings to travel up-hole through an annular area. Further milling assemblies provide where the stroking device extends linearly to maintain a downward pressure on the milling assembly. Further milling assemblies provide where the flow-by anchor remains in a temporarily fixed position relative to a casing while the milling assembly mills a secondary wellbore.

Provided herein are various embodiments of a method for milling a casing exit window and secondary wellbore containing the steps of positioning an orientation anchor within a primary wellbore, lowering a tubular string having a flow-by anchor into the primary wellbore, removably attaching the flow-by anchor to a casing so that it has a temporarily fixed position relative to the casing, allowing mud to travel downhole to cause a downhole motor to rotate, and milling out a casing exit window using a milling assembly driven by the downhole motor while the flow-by anchor remains in its temporarily fixed position relative to the casing.

Further milling methods contain extending slips away from the flow-by anchor to engage with the casing. Further milling methods contain pulling upwardly on the tubular string to dis-engage the slips. Further milling methods contain attaching a deflector to the orientation anchor. Further milling methods contain milling out a secondary wellbore by deflecting the milling assembly with the deflector while the flow-by anchor remains in its temporarily fixed position relative to the casing.

10 floating rig well system
12 main tubular string
12A upper tubing
12B intermediate tubing
14 floating rig
17 mud
18 cuttings
19 annular area
20 sea floor
22 wellbore
23 casing
25 surface of water
75 slips
100 orientation anchor
125 lower completion
150 flow-by anchor
175 stroking device
200 downhole motor
225 milling assembly
250 casing exit window
275 primary wellbore
300 secondary wellbore
350 upper connecting tubular string
360 mid connecting tubular string
370 lower connecting tubular string
400 deflector FIG. 1 illustrates a cross-sectional view of a floating rig well system 10 in accordance with some embodiments of the present disclosure and showing the location for Detail A within the downhole portion of the floating rig well system 10. A floating rig 14 may have adequate flotation so that it remains at or near the surface of the water 25, positioned within any large body of water including but not limited to sea water, fresh water, brackish water, and any combination of these. A tubular string 12 may extend downwardly from the floating rig 14 and may be rotated by engines and motors placed on the floating rig 14. A casing 23 may be used to secure the walls of a wellbore 22 as the system performs various milling operations into the subterranean areas beneath the sea floor 20.

Figure 2:
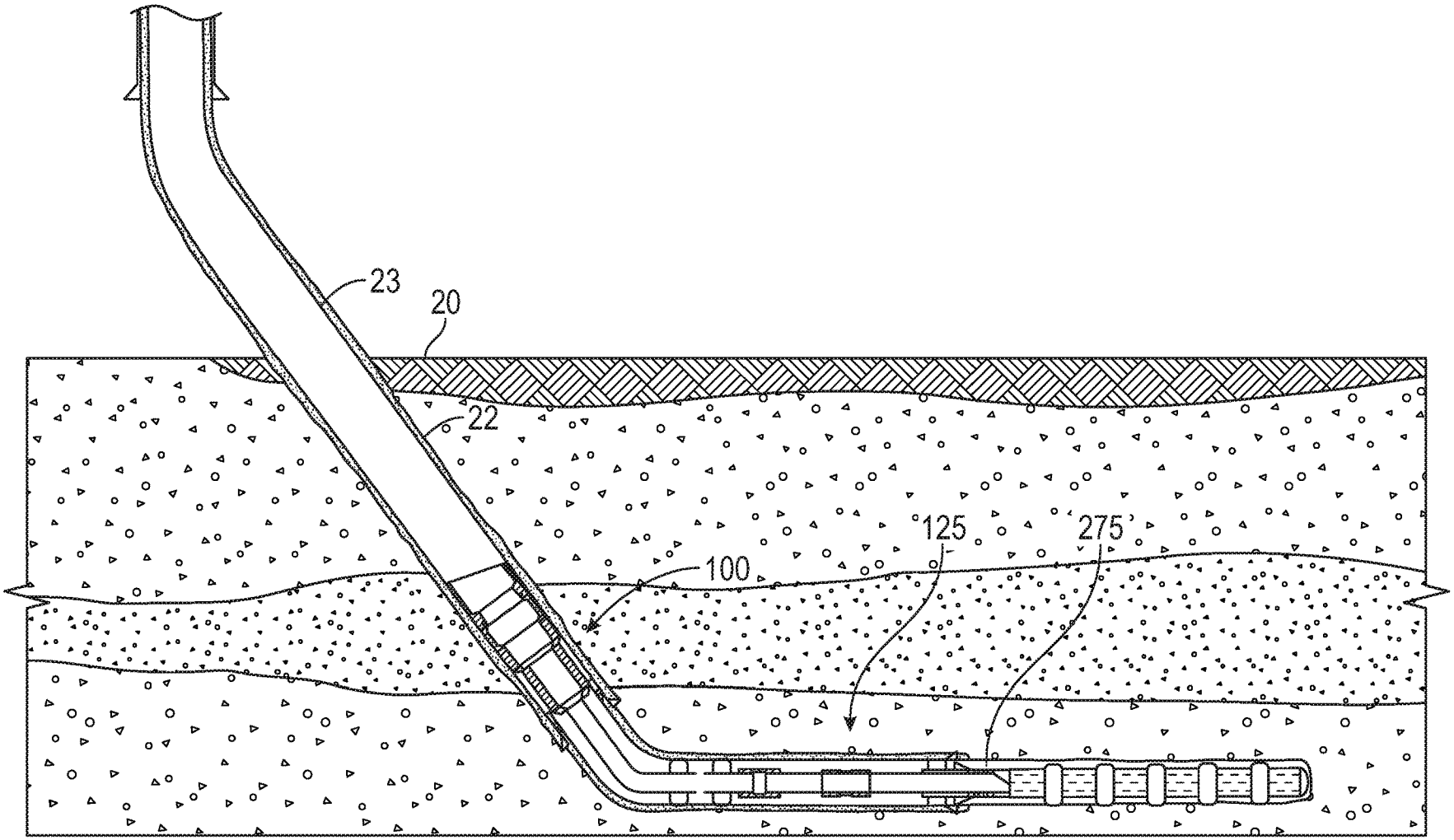
FIG. 2 illustrates a detailed cross-sectional view of Detail A showing a downhole portion of a floating rig well system, where the system is shown in a starting condition.

FIG. 2 illustrates a detailed cross-sectional view of Detail A showing a downhole portion of a floating rig well system 10, where the system is shown in a starting condition. An orientation anchor 100 has been attached to the casing 23 with a lower completion 125 installed within the casing 23 and downhole of the anchor 100. The lower completion 125 may be located within a primary wellbore 275 and may extend past the end of the casing 23.

Figure 3:
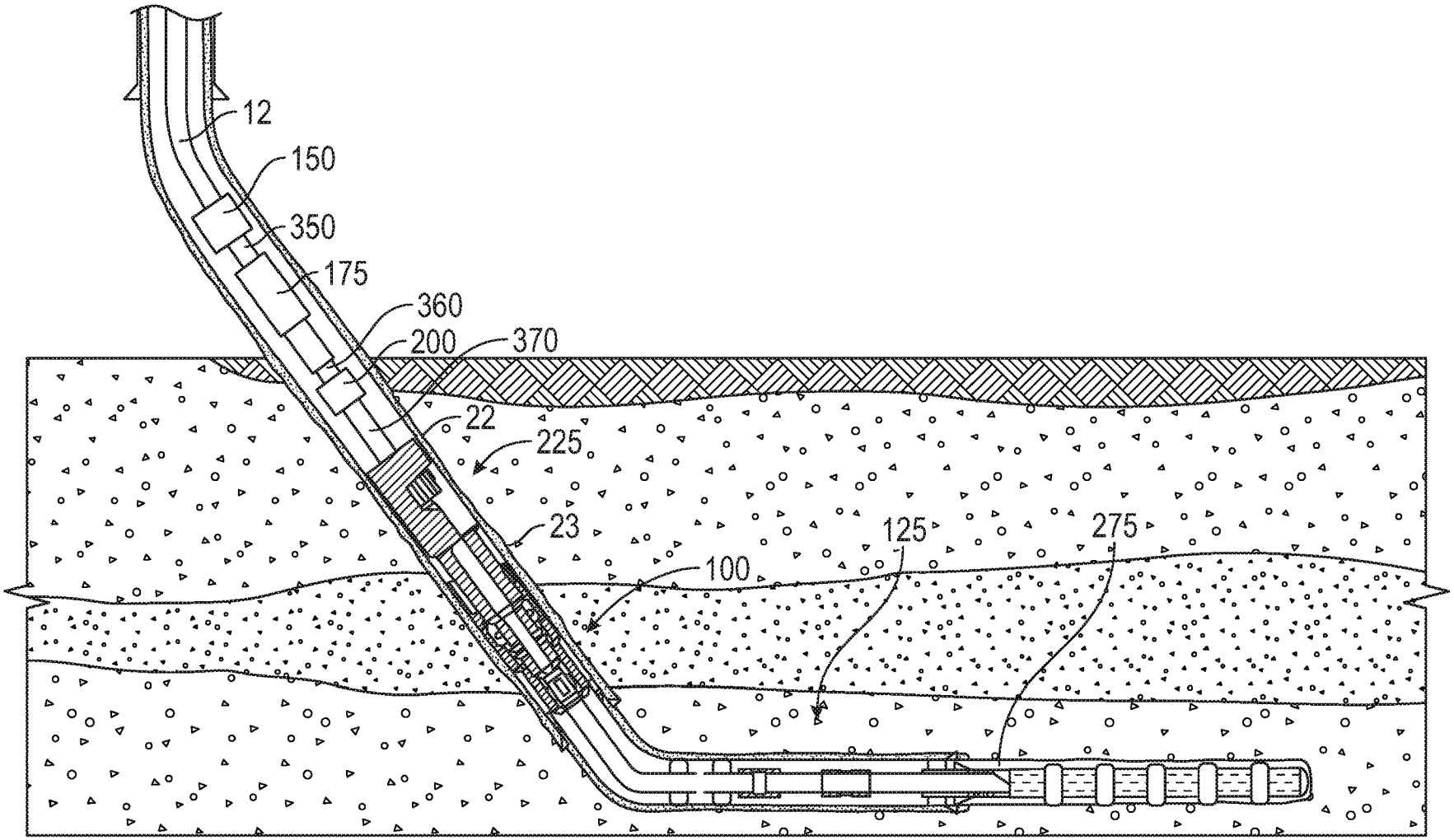
FIG. 3 illustrates a detailed cross-sectional view of Detail A showing a downhole portion of a floating rig well system, where the run-in-hole (RIH) milling assembly and other components are lowered into the wellbore.

FIG. 3 illustrates a detailed cross-sectional view of Detail A showing a downhole portion of a floating rig well system 10, where the milling assembly 225, which may be a RIH milling assembly, and other components are lowered into the wellbore 22. A main tubular string 12 may attach to a flow-by anchor 150 and continue downhole to connect with an upper connecting tubular string 350, which may extend to connect with a stroking device 175 which may be a hydraulic stroking device. A downhole portion of the stroking device 175 may connect with a mid connecting tubular string 360 which may connect at a first end with the stroking device 175 and connect at a second end with a downhole motor 200. A lower connecting tubular string 370 may be used to connect at a first end with the downhole motor 200 and at a second end with a milling assembly 225. As the system is lowered into the wellbore 22, each component retains its relative position until the milling assembly is landed on the orientation anchor 100.

Figure 4:
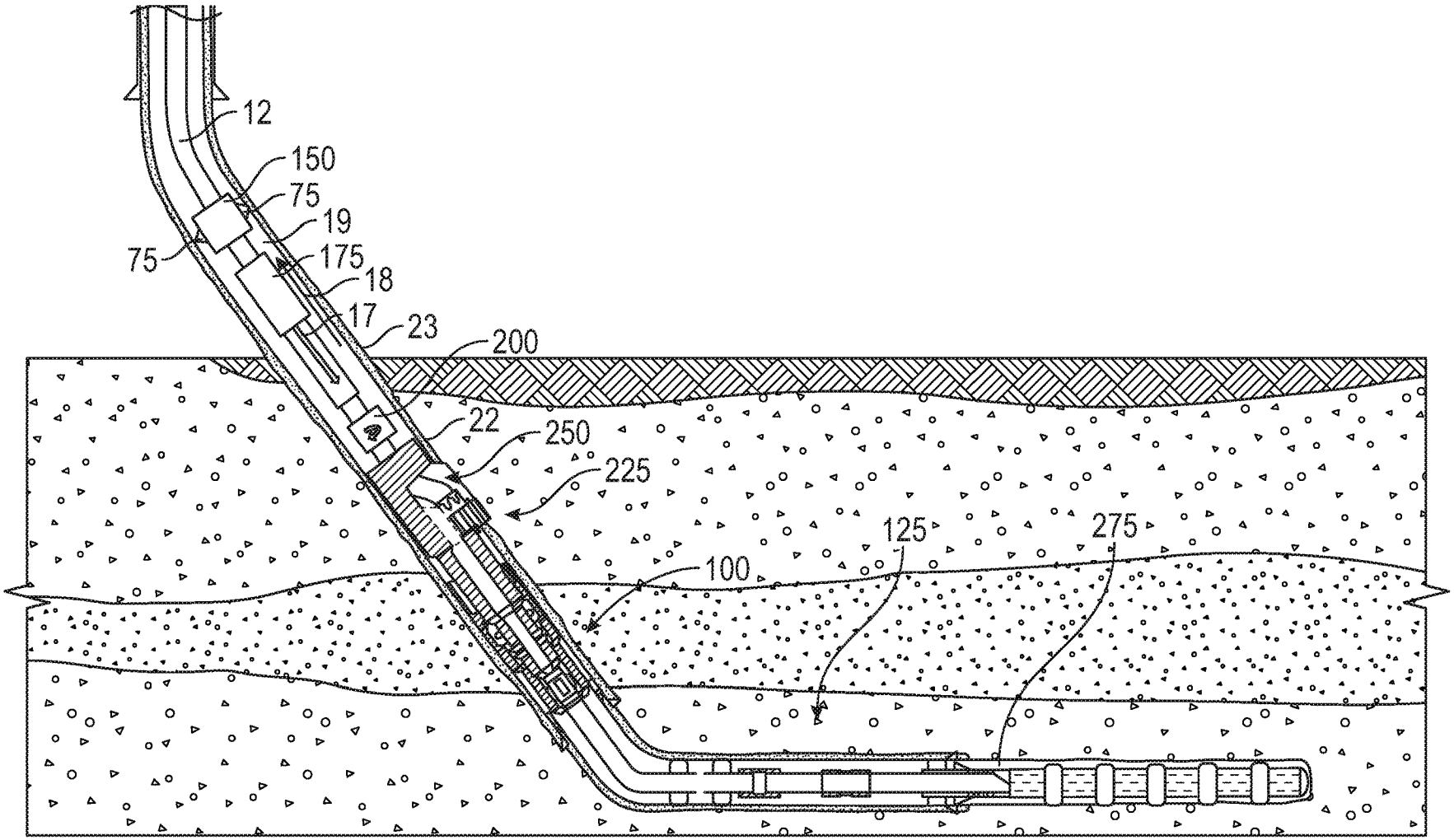
FIG. 4 illustrates a detailed cross-sectional view of Detail A showing a downhole portion of a floating rig well system, where the casing exit window is being milled.

FIG. 4 illustrates a detailed cross-sectional view of Detail A showing a downhole portion of a floating rig well system 10, where the casing exit window 250 is being milled. The flow-by anchor 150 may be removably attached to the casing 23. In some embodiments, the flow-by anchor may be attached to the casing 23 by slips 75 which may be hydraulically activated or extended away from the flow-by anchor 150 based on the hydraulic pressure from the mud 17 being pushed downhole.

Fluid flow (mud 17) may be pumped down the main tubular string 12 from the floating rig 14 to the motor 200 where the flow of the fluid may cause the motor 200 to begin rotating which may cause the milling operation to begin. The flow-by anchor 150 preferably remains in its fixed position with the casing 23 while the mud 17 is permitted to flow past the flow-by anchor 150 and downhole to the motor 200. While the milling process is being performed, the cuttings 18 that are produced may be forced into the annular area 19 between the main tubular string 12 and the casing 23, so that the cuttings 18 may travel up-hole to the surface. In other words, the flow-by anchor 150 may remain in its temporary position throughout the milling process while mud 17 flows downhole to the motor 200 and simultaneously cuttings 18 as a result of the milling process may flow up-hole through the annular area 19 to the surface.

The flow-by anchor 150 may remain in place while the stroking device 175 may begin its stroking process where it may extend linearly downhole to move the milling assembly 225 downhole until making contact with the interior wall of the casing 23 in the location where the casing exit window 250 is desired. This linear motion by the stroking device 175 may be driven by the flow of the mud 17 from the floating rig 14 above. Once contacting the casing 23, the stroking device 175 may create a downward pressure on the milling assembly 225 to ensure adequate pressure on the bit of the milling assembly as it removes material from the casing 23. This downward pressure from the stroking device 175 may be maintained throughout the entire process of milling out the casing exit window 250.

Figure 5:
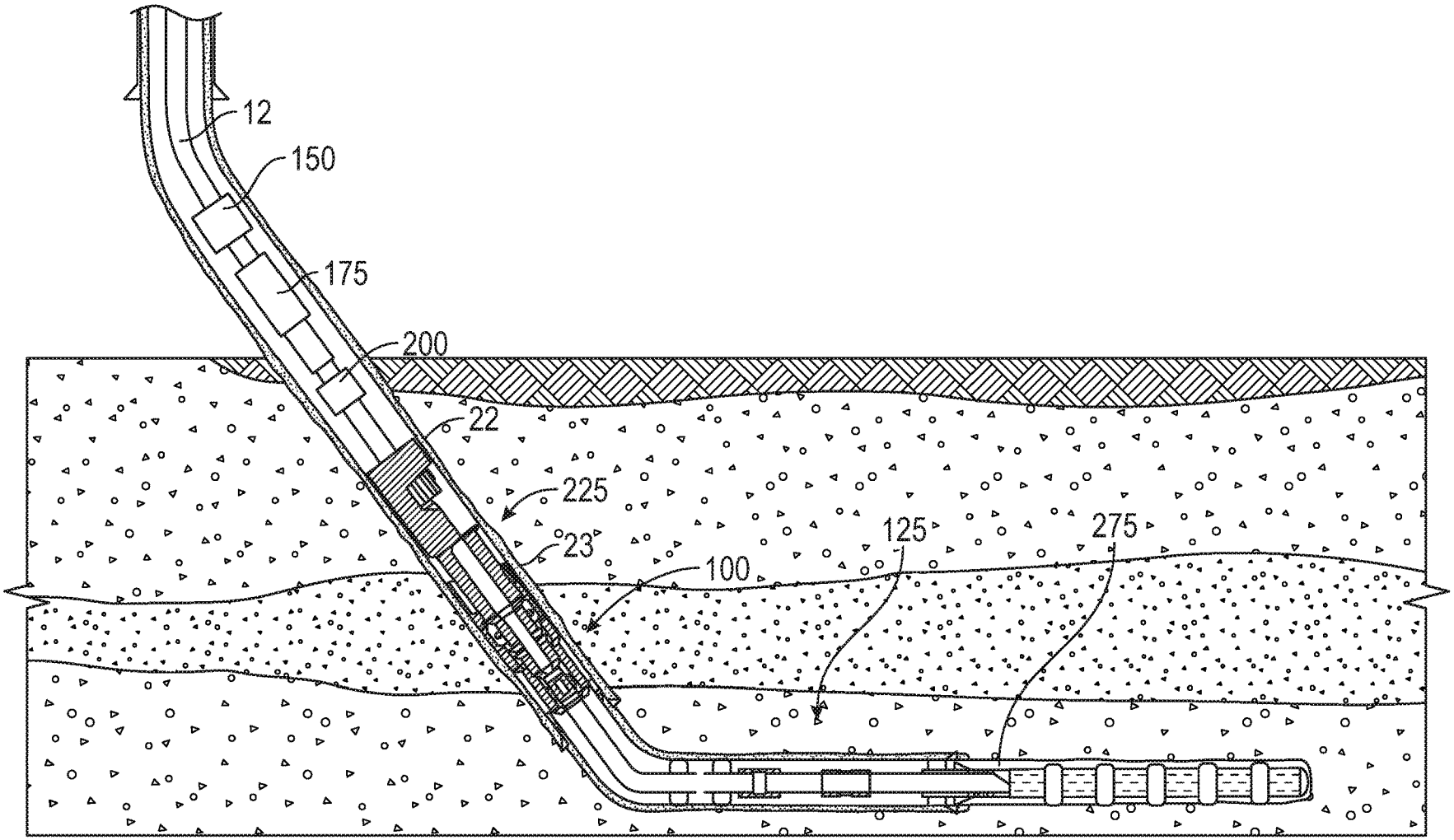
FIG. 5 illustrates a detailed cross-sectional view of Detail A showing a downhole portion of a floating rig well system, where the RIH milling assembly is being removed.

FIG. 5 illustrates a detailed cross-sectional view of Detail A showing a downhole portion of a floating rig well system 10, where the RIH milling assembly is being removed. The fluid flow coming up-hole from the lower completion 125 may be stopped and once this is done the fluid flow through the motor 200 should stop which would then stop rotation of the motor 200 and any linear stroking of the stroking device 175. An upward force may be applied to the main tubular string 12 which may release the flow-by anchor's 150 temporary attachment to the casing 23 (i.e. the slips 75). Further upward force may be applied to the main tubular string 12 to pull up the bit or mill to its original position prior to the start of the milling process. The stroking device 175 may remain at the extended length even when pulled to the surface. Further upward force may be applied to the main tubular string 12 to disengage or release the milling assembly 225 from the orientation anchor 100. Further upward force may be applied to the main tubular string 12 to pull the entire assembly to the surface.

Figure 6:
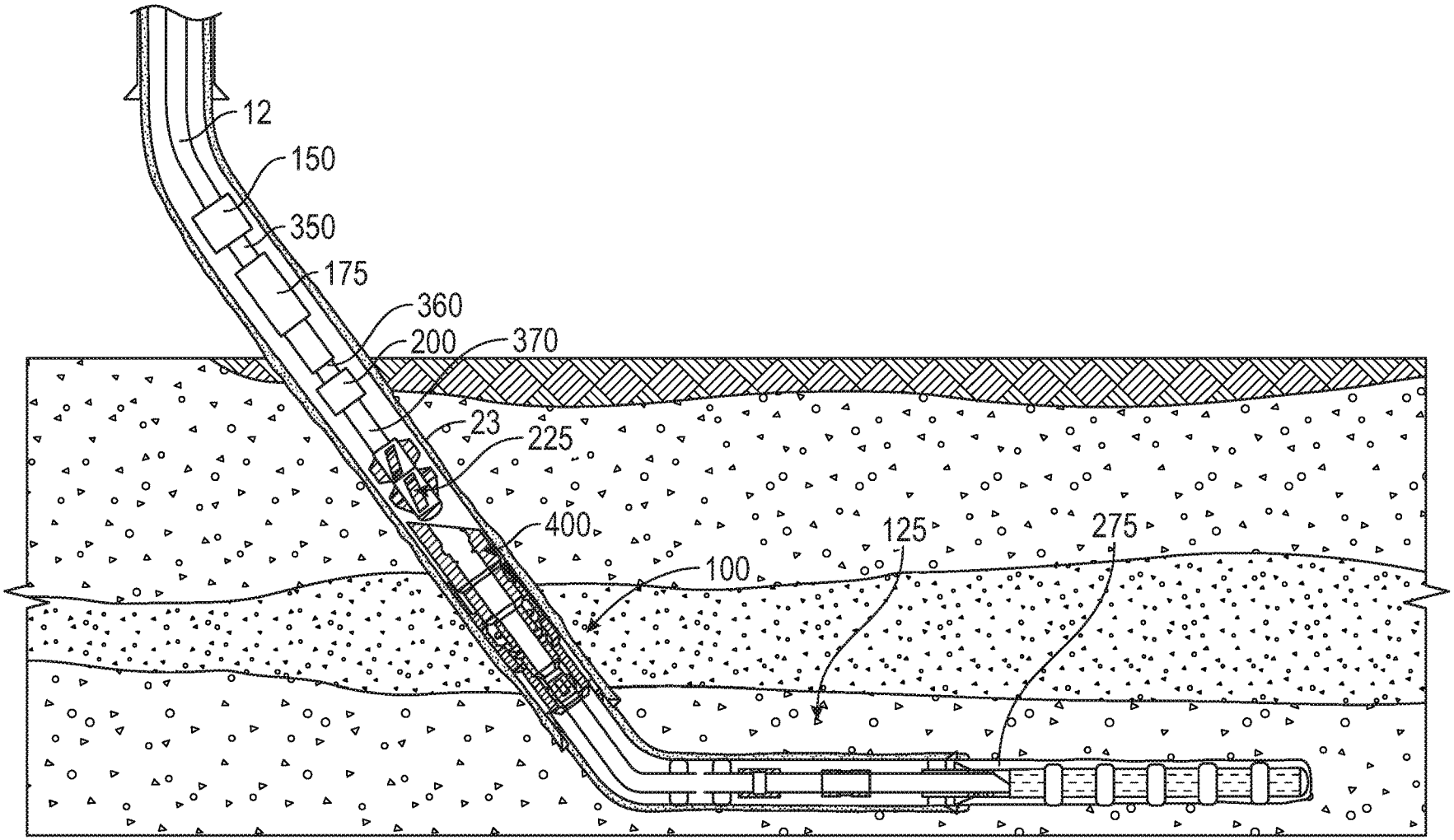
FIG. 6 illustrates a detailed cross-sectional view of Detail A showing a downhole portion of a floating rig well system, where the milling assembly is being lowered and a deflector has already been landed on an orientation anchor.

FIG. 6 illustrates a detailed cross-sectional view of Detail A showing a downhole portion of a floating rig well system, where the milling assembly 225 is being lowered and a deflector 400 has already been landed on an orientation anchor 100. The deflector 400 may form a part of the milling assembly 225 as the system is lowered into the wellbore 22. A main tubular string 12 may attach to a flow-by anchor 150 and continue downhole to connect with an upper connecting tubular string 350, which may extend to connect with a stroking device 175 which may be a hydraulic stroking device. A downhole portion of the stroking device 175 may connect with a mid connecting tubular string 360 which may connect at a first end with the stroking device 175 and connect at a second end with a downhole motor 200. A lower connecting tubular string 370 may be used to connect at a first end with the downhole motor 200 and at a second end with a milling assembly 225. As the system is lowered into the wellbore 22, each component retains its relative position until the milling assembly is landed on the orientation anchor 100.

Figure 7:
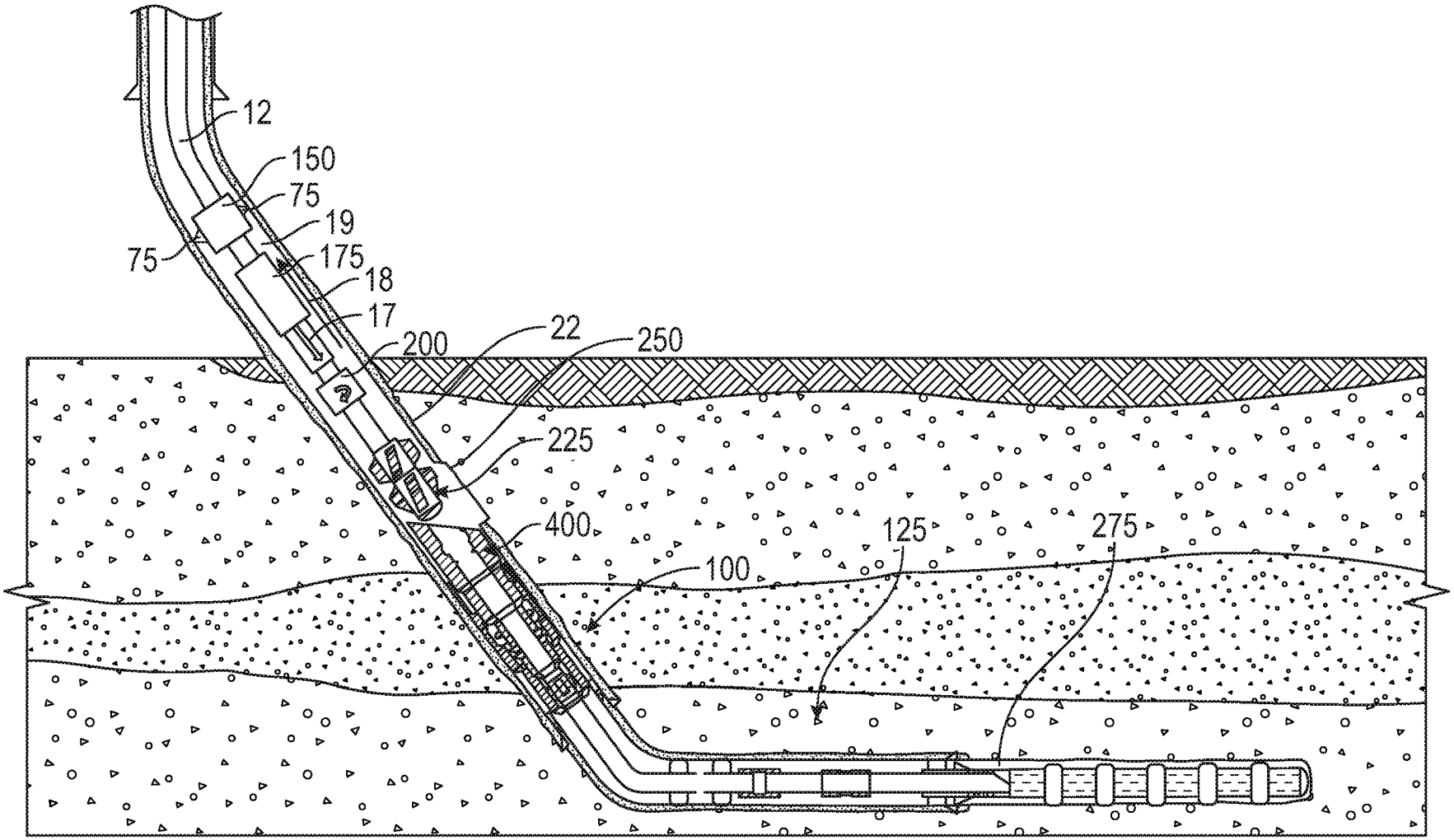
FIG. 7 illustrates a detailed cross-sectional view of Detail A showing a downhole portion of a floating rig well system, where the casing exit window is being milled.

FIG. 7 illustrates a detailed cross-sectional view of Detail A showing a downhole portion of a floating rig well system 10, where the casing exit window 250 is being milled. The flow-by anchor 150 may be temporarily attached (removably attached) to the interior wall of the casing 23 using the slips 75 which may be hydraulically activated. Fluid flow (mud 17) may be pumped down the main tubular string 12 from the floating rig 14 to the motor 200 where the flow of the fluid may cause the motor 200 to begin rotating which may cause the milling operation to begin. The flow-by anchor 150 preferably remains in its fixed position with the casing 23 while the mud 17 is permitted to flow past the flow-by anchor 150 and downhole to the motor 200. While the milling process is being performed, the cuttings 18 that are produced may be forced into the annular area 19 between the main tubular string 12 and the casing 23, so that the cuttings 18 may travel up-hole to the surface. In other words, the flow-by anchor 150 may remain in its temporary position throughout the milling process while mud 17 flows downhole to the motor 200 and simultaneously cuttings 18 as a result of the milling process may flow up-hole through the annular area 19 to the surface.

The flow-by anchor 150 may remain in place while the stroking device 175 may begin its stroking process where it may extend linearly downhole to move the milling assembly 225 downhole until making contact with the interior wall of the casing 23 in the location where the casing exit window 250 is desired. This linear motion by the stroking device 175 may be driven by the flow of the mud 17 from the floating rig 14 above. Once contacting the casing 23, the stroking device 175 may create a downward pressure on the milling assembly 225 to ensure adequate pressure on the bit of the milling assembly as it removes material from the casing 23. This downward pressure from the stroking device 175 may be maintained throughout the entire process of milling out the casing exit window 250.

Figure 8:
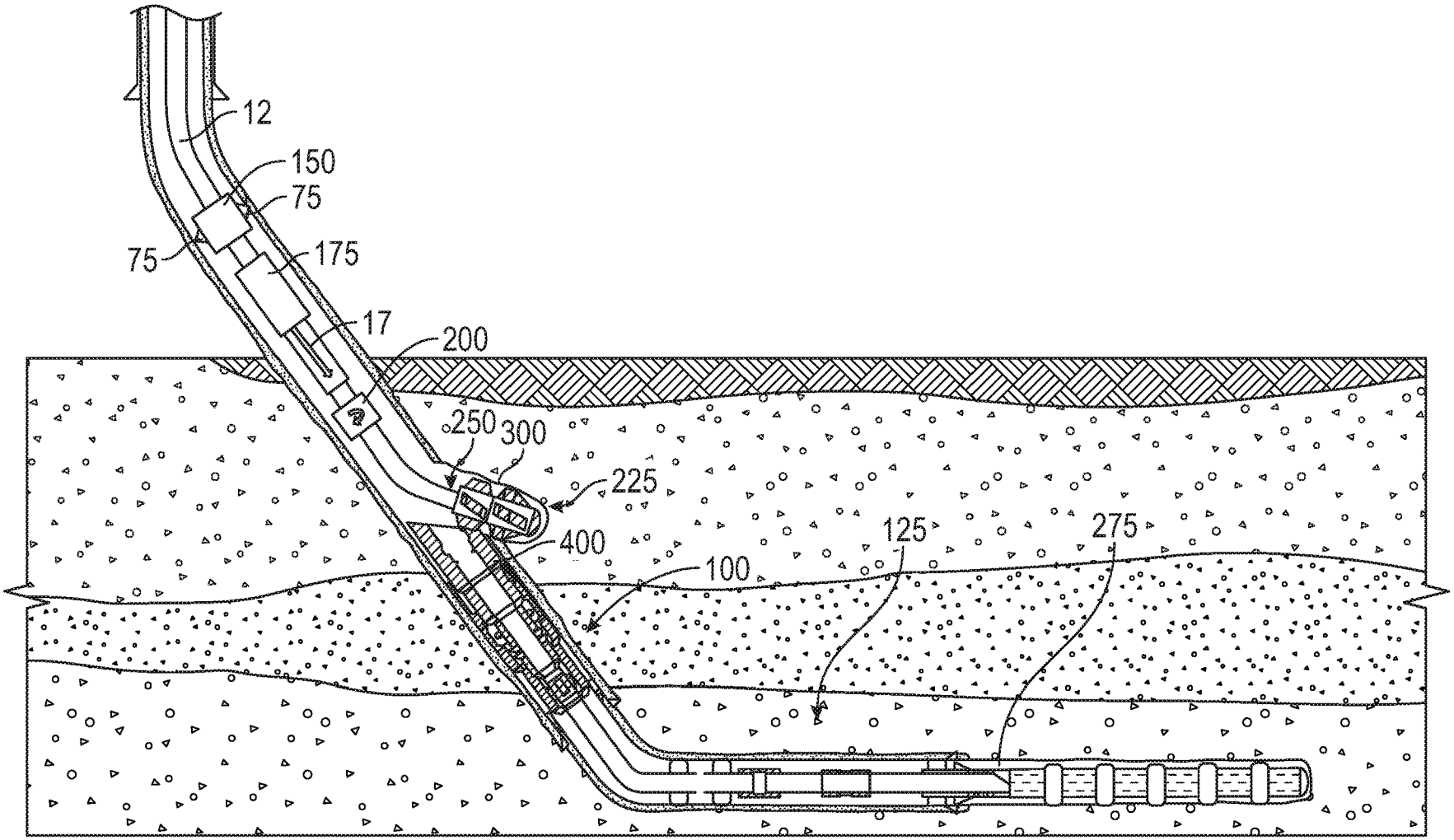
FIG. 8 illustrates a detailed cross-sectional view of Detail A showing a downhole portion of a floating rig well system, where a secondary wellbore is being milled.

FIG. 8 illustrates a detailed cross-sectional view of Detail A showing a downhole portion of a floating rig well system 10, where a secondary wellbore 300 is being milled. Fluid flow (either production or otherwise) from the lower completion 125 may flow up-hole to the motor 200 which may cause the rotation of the milling assembly 225 to continue into the subterranean formation to travel past the casing exit window 250 and begin to mill the secondary wellbore 300. This process can be continued until the desired depth for the secondary wellbore 300 has been reached for this process.

Figure 9:
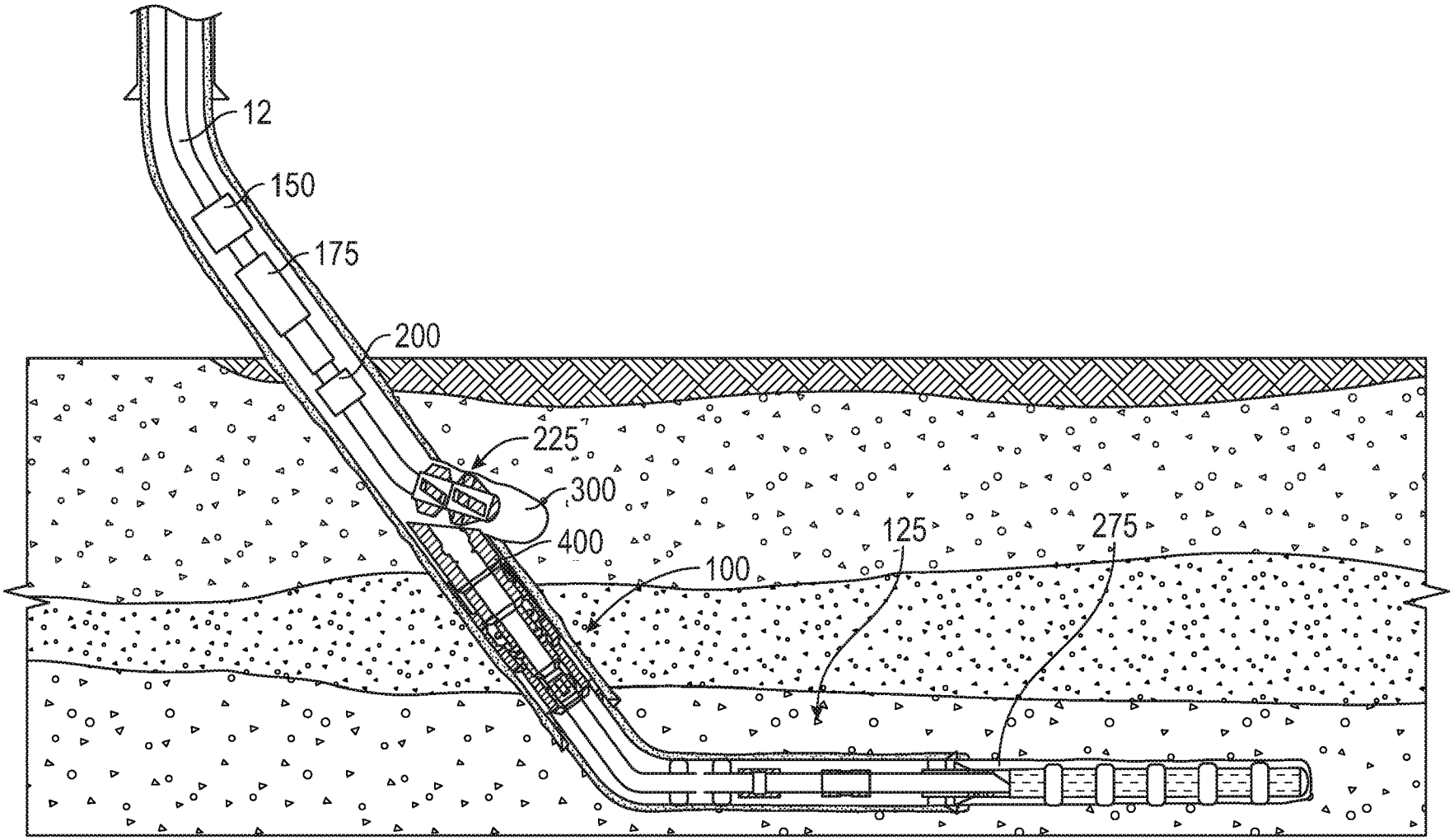
FIG. 9 illustrates a detailed cross-sectional view of Detail A showing a downhole portion of a floating rig well system, where the RIH milling assembly is being removed.

FIG. 9 illustrates a detailed cross-sectional view of Detail A showing a downhole portion of a floating rig well system 10, where the milling assembly 225 is being removed. The fluid flow coming up-hole from the lower completion 125 may be stopped and once this is done the fluid flow through the motor 200 should stop which would then stop rotation of the motor 200 and any linear stroking of the stroking device 175. An upward force may be applied to the main tubular string 12 which may release the flow-by anchor's 150 temporary attachment to the casing 23, which in some cases would be the slips 75 which extend outwardly from the flow-by anchor 150. Further upward force may be applied to the main tubular string 12 to pull up the bit or mill to the surface. The stroking device 175 may remain at the extended length even when pulled to the surface. Further upward force may be applied to the main tubular string 12 to disengage or release the milling assembly 225 from the orientation anchor 100. Further upward force may be applied to the main tubular string 12 to pull the entire assembly to the surface.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole motor milling assembly comprising:

a tubular string surrounded by a casing with an annular area in between the tubular string and the casing;

a flow-by anchor positioned on the tubular string to allow mud to simultaneously flow downhole through the tubular string and up-hole through the annular area;

a stroking device positioned on the tubular string and downhole from the flow-by anchor;

a downhole motor positioned on the tubular string and downhole from the stroking device; and a milling assembly positioned on an end of the tubular string;

wherein the stroking device is configured to create a downward pressure on the milling assembly to mill a secondary wellbore while cuttings flow up-hole through the annular area.

2. The downhole motor milling assembly of claim 1 wherein:

the flow-by anchor is configured to attach to a casing while permitting mud to flow past the flow-by anchor and through the tubular string.

3. The downhole motor milling assembly of claim 1 wherein:

the flow-by anchor is configured to hold a position within a casing while cuttings travel up-hole through the annular area.

4. The downhole motor milling assembly of claim 1 wherein:

the flow-by anchor is configured to hold a position within the casing while the milling assembly performs a milling operation.

5. The downhole motor milling assembly of claim 1 wherein:

the flow-by anchor is configured to hold a position within the casing while the flow of mud through the tubular string causes the downhole motor to rotate.

6. The downhole motor milling assembly of claim 1 wherein:

the flow-by anchor is configured to hold a position within the casing while the stroking device extends linearly.

7. The downhole motor milling assembly of claim 6 wherein:

the stroking device extends in a direction that is downhole.

8. A downhole motor milling assembly comprising:

a tubular string surrounded by a casing with an annular area in between the tubular string and the casing;

a flow-by anchor positioned on the tubular string to allow a flow of mud downhole through the tubular string;

slips which extend outwardly from the flow-by anchor to temporarily attach to the casing;

a stroking device positioned on the tubular string and downhole from the flow-by anchor;

a downhole motor positioned on the tubular string and downhole from the stroking device and driven by the flow of mud downhole through the tubular string; and a milling assembly positioned on an end of the tubular string such that cuttings can flow up-hole through the annular area and past the flow-by anchor.

9. The downhole motor milling assembly of claim 8 wherein:

the stroking device is configured such that the flow of mud downhole through the main tubular string causes the stroking device to extend linearly.

10. The downhole motor milling assembly of claim 8 further comprising:

an orientation anchor attached to the casing.

11. The downhole motor milling assembly of claim 10 further comprising:

a deflector attached to the orientation anchor.

12. The downhole motor milling assembly of claim 8 wherein the slips are configured to engage with the casing to hold the flow-by anchor in a temporarily fixed position relative to the casing while the milling assembly removes a portion of the casing.

13. The downhole motor milling assembly of claim 8 the flow-by anchor is configured to allow mud to travel downhole through the tubular string while simultaneously permitting cuttings to travel up-hole through an annular area.

14. The downhole motor milling assembly of claim 8 the stroking device extends linearly to maintain a downward pressure on the milling assembly.

15. The downhole motor milling assembly of claim 8 wherein:

the flow-by anchor is configured to remain in a temporarily fixed position relative to a casing while the milling assembly mills a secondary wellbore.

16. A method for milling a casing exit window and secondary wellbore comprising the steps of:

positioning an orientation anchor within a primary wellbore;

lowering a tubular string having a flow-by anchor into the primary wellbore;

removably attaching the flow-by anchor to a casing so that it has a temporarily fixed position relative to the casing;

allowing mud to travel downhole through the tubular string and past the flow-by anchor to cause a downhole motor to rotate; and milling out a casing exit window using a milling assembly driven by the downhole motor while the flow-by anchor remains in its temporarily fixed position relative to the casing and simultaneously allows cuttings to travel up-hole through an annular area between the tubular string and the casing.

17. The method of claim 16 further comprising:

extending slips away from the flow-by anchor to engage with the casing.

18. The method of claim 17 further comprising:

pulling upwardly on the tubular string to dis-engage the slips.

19. The method of claim 16 further comprising:

attaching a deflector to the orientation anchor.

20. The method of claim 19 further comprising:

milling out a secondary wellbore by deflecting the milling assembly with the deflector while the flow-by anchor remains in its temporarily fixed position relative to the casing.

* * * * *